US009349527B2

(12) United States Patent
Trinh et al.

(10) Patent No.: US 9,349,527 B2
(45) Date of Patent: May 24, 2016

(54) CURRENT TRANSFORMER HAVING AN AUTOMATIC SHORT-CIRCUIT DEVICE

(71) Applicant: PHOENIX CONTACT GMBH & CO. KG, Blomberg (DE)

(72) Inventors: Dat-Minh Trinh, Barntrup (DE); Markus Becker, Paderborn (DE)

(73) Assignee: PHOENIX CONTACT GMBH & CO. KG (DE)

( * ) Notice: Subject to any disclaimer, the term of this patent is extended or adjusted under 35 U.S.C. 154(b) by 0 days.

(21) Appl. No.: 14/420,344

(22) PCT Filed: Aug. 7, 2013

(86) PCT No.: PCT/EP2013/066586

§ 371 (c)(1),
(2) Date: Feb. 6, 2015

(87) PCT Pub. No.: WO2014/023785

PCT Pub. Date: Feb. 13, 2014

(65) Prior Publication Data

US 2015/0206650 A1 Jul. 23, 2015

(30) Foreign Application Priority Data

Aug. 8, 2012 (DE) ..... 10 2012 107 277

(51) Int. Cl.
*H01F 27/29* (2006.01)
*H01F 27/02* (2006.01)
(Continued)

(52) U.S. Cl.
CPC ..... *H01F 27/402* (2013.01); *H01F 27/04* (2013.01); *H01F 27/29* (2013.01)

(58) Field of Classification Search
CPC ..... H01F 27/402; H01F 27/29; H01F 27/04; H01F 27/40; H01F 27/247; H01F 38/28; H01F 38/30; H01F 38/32; H01F 38/34
USPC ..... 336/192, 90, 173, 174
See application file for complete search history.

(56) References Cited

U.S. PATENT DOCUMENTS 1,667,617 A * 4/1928 Zelt ..... H01F 38/30 200/2
1,786,746 A 12/1930 Gibbs
(Continued)

FOREIGN PATENT DOCUMENTS

DE 1613706 B 10/1967
FR 2682217 A1 9/1993
(Continued)

OTHER PUBLICATIONS

International Search Report received in International Patent Application No. PCT/EP2013/066586, dated Nov. 14, 2013.
(Continued)

*Primary Examiner* — Mangtin Lian
(74) *Attorney, Agent, or Firm* — Knobbe, Martens, Olson & Bear, LLP

(57) ABSTRACT

The invention relates to a current transformer 1, comprising connection contacts 3 for contacting a secondary winding of the current transformer and a short-circuit device 105, 205, 305 for shorting the connection contacts 3, wherein the connection contacts 3 can be reached through a housing opening 4 of a housing 2 surrounding the current transformer 1, the current transformer also having a safety device 107, 207, 307 for blocking the access to the connection contacts 3 lying inside the housing, wherein the safety device 107, 207, 307 can be in a securing status or release status, and wherein the access to the connection contacts 3 is blocked by the safety device 107, 207, 307 in the securing status, such that the connection of a conductor to a connection contact 3 or the disconnection of a conductor from a connection contact 3 is not possible, and wherein the access to the connection contacts 3 is released by the safety device in the release status and the short-circuit device 105, 205, 305 shorts the connection contacts 3 in the release status, such that the connection of a conductor to a connection contact 3 or a disconnection of a conductor from a connection contact 3 is possible.

20 Claims, 6 Drawing Sheets

Figure 1A:
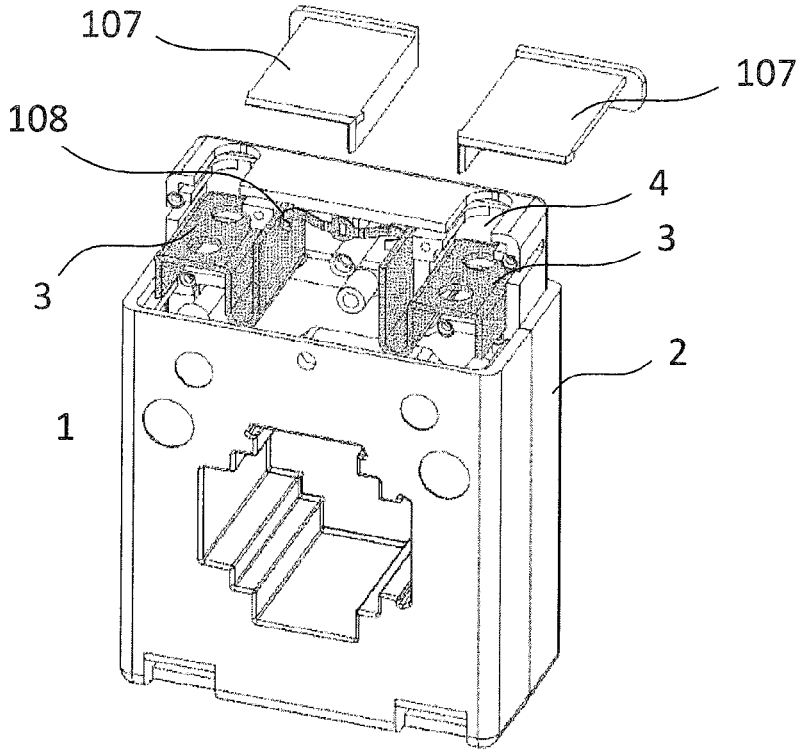

(51) Int. Cl.

| | |
|---|---|
| ***H01F 38/20*** | (2006.01) |
| ***H01F 27/40*** | (2006.01) |
| ***H01F 27/04*** | (2006.01) |

(56) References Cited

U.S. PATENT DOCUMENTS

| | | | | |
|---|---|---|---|---|
| 2,345,584 | A | 4/1944 | Chiles | |
| 3,208,021 | A * | 9/1965 | Elliott | H01F 27/40 200/302.1 |
| 3,657,503 | A * | 4/1972 | Smith | H01F 27/40 174/138 F |
| 2009/0186504 | A1 | 7/2009 | Santos | |

FOREIGN PATENT DOCUMENTS

| | | |
|---|---|---|
| GB | 1197299 | 11/1967 |
| JP | 59-22308 A | 2/1984 |

OTHER PUBLICATIONS

Office Action received in German Application No. 10 2012 107 277.9, dated Apr. 30, 2013.

* cited by examiner

CURRENT TRANSFORMER HAVING AN AUTOMATIC SHORT-CIRCUIT DEVICE

REFERENCE TO RELATED APPLICATIONS

This application is the U.S. National Phase of International Application PCT/EP2013/066586, filed Aug. 7, 2013, and claims priority to DE Application No. 10 2012 107 277.9, filed Aug. 8, 2012. Each of the priority applications is hereby incorporated by reference in its entirety.

The invention relates to a current transformer having an automatic short-circuit device with which the secondary winding of the current transformer is automatically shorted once a safety device, such as protection against manipulation, has been released.

Current transformers are usually used to measure alternating currents and operate in accordance with the principle of the Rogowski coil. Here, an alternating current flowing in a primary coil or in a primary conductor induces an electric current in a secondary coil that is generally arranged annularly. The primary coil often has only very few windings or only a single winding compared to the secondary coil due to the fact that the primary conductor is passed through the secondary coil. In this case reference is made to a window-type transformer or straight-through transformer. The magnitude of the current induced in the secondary winding is dependent on the number of secondary windings and is substantially proportional to the inducing primary current. It is therefore very suitable as a measurand or control variable.

In contrast to the Rogowski coil, a current transformer has a usually toroidal ferromagnetic core which, by the bundling of the magnetic field, ensures a high efficacy and a high accuracy in terms of the proportionality between primary and secondary current.

On account of the high efficacy, a current transformer generates secondary currents high enough to directly control or regulate further circuit components without further amplification.

However, this causes the disadvantage that a secondary circuit of a current transformer must never be operated open, since otherwise the very high ("infinite") resistance between the open secondary terminals leads to very high voltages therebetween. These would not only pose a risk to humans, but would also lead to voltage flashovers and breakdowns, which can destroy the current transformer.

One advantage of current transformers is the galvanic isolation of primary and secondary current. The secondary circuit is therefore independent of the potential of the primary circuit. Fundamentally potential-free modifications of the secondary circuit are thus possible without having to disconnect a primary circuit, which is not potential free.

There is thus a motivation, for example in power supply arrangements, to be able to make modifications to a circuit arrangement of the secondary circuit with a current transformer in operation on the primary side, without the current transformer being destroyed by an interim interruption of the secondary circuit.

This objective can be achieved by temporarily shorting the secondary circuit of the current transformer prior to the separation of connection conductors. This can be implemented for example by an external wire bridge, but also via an incorporated short-circuit device provided especially for the current transformer.

In order to reduce the risk here of misuse by humans, solutions that provide an automatic shorting of the secondary circuit as soon as the connections to the current transformer are detached are already known from the prior art.

US 2009/0186504 A1 describes a connection system for a current transformer in which, besides the electrical contacts, a plug contact additionally has a pin, the removal of which causes a shorting of the secondary contacts.

Further, DE 16 13 706 B describes a short-circuit arrangement for the secondary circuit of a current transformer, in which the removal of a pin associated with a plug contact also leads to the shorting of the short-circuit arrangement.

In order to enable a closing or opening of the short-circuit arrangement, however, both solutions require specially formed plug contacts on the circuit side.

The object of the invention is to specify a current transformer having an improved automatic short-circuit device that allows a direct connection of conductors to the current transformer.

The object is achieved in accordance with the invention by the features of the subject matter of claim 1. Advantageous embodiments of the invention are specified in the dependent claims.

In accordance with the invention a current transformer is therefore provided that comprises connection contacts for contacting a secondary winding, which connection contacts can be reached through a housing opening of the housing surrounding the current transformer, wherein the current transformer has a short-circuit device for shorting the connection contacts and the short-circuit device has a mechanically movable conductor that can be brought into a circuit between the connection contacts of the secondary winding, the current transformer having a safety device for blocking the access to the connection contacts lying inside the housing, which safety device can be in a securing status or release status, wherein the access to the connection contacts is blocked by the safety device in the securing status, such that the connection of a conductor to a connection contact or the disconnection of a conductor from a connection contact is not possible and the access to the connection contacts is released by the safety device in the release status and the short-circuit device shorts the connection contacts in the release status, such that the connection of a conductor to a connection contact or a disconnection of a conductor from a connection contact is possible.

The advantages of this solution lie in the fact that the connection contacts do not need to have any special requirements of a manufacturing of the conductor to be connected and at the same time the safety device reduces the risk of misuse in cooperation with the short-circuit device.

The connection contacts can be formed such that stripped conductors can be contacted directly.

The connection contacts can thus be formed for example as screw or clamp contacts that are to be manipulated via a housing opening.

The access to the connection or actuation mechanism of the connection contacts is understood to be the access to the connection contacts.

With a blocking of the access to the connection contacts, the safety device thus ensures that an appropriate detachment of connected conductors is not possible in the normal operating state, in which the safety device is in the securing status.

In other words, a connection or disconnection of conductors to/from the connection contacts of the secondary winding is only possible if the safety device has been released or brought into a release status beforehand. In this release status the secondary connections of the current transformer are automatically shorted via the short-circuit device.

It is therefore not possible to disconnect a conductor from a connection contact of the secondary winding without actuating the safety device and therefore automatically shorting the secondary circuit of the current transformer.

The safety device can be formed advantageously as a cover sleeve which can be inserted into the housing in such a way that it blocks the access to the connection contacts and at the same time opens the short-circuit device.

Such a cover sleeve can be formed from a preferably flat piece of an insulating material. Such a cover sleeve can be slid into the housing through a slot and can perform two tasks equally. On the one hand it can close the housing opening as access to the connection contacts with appropriate geometric shaping. On the other hand it can open the short-circuit device by sliding in an insulating manner between two contacts of the short-circuit device.

Here, the cover sleeve can be formed in one part or a number of parts, wherein it is not ruled out that a one-part cover sleeve also closes a plurality of housing openings to a plurality of connection contacts simultaneously.

The short-circuit device is therefore formed advantageously as a disconnecting switch, via which the circuit between the connection contacts can be disconnected by the cover sleeve in the securing status as described previously.

The short-circuit device is advantageously formed here such that it has a sprung conductor via which the circuit between the connection contacts can be closed, each of the connection contacts has a short-circuit contact or is electrically conductively connected to such a contact, the cover sleeve is formed from insulating material, and the cover sleeve can be inserted between the sprung conductor and the short-circuit contact in an insulating manner, such that the circuit between the connection contacts is interrupted.

Such an arrangement has only few components and offers great freedom and adaptability in terms of the geometric embodiment.

In an advantageous embodiment of the invention the safety device can be formed as a flap mechanism.

Such a flap mechanism advantageously has an insulating separation element and flaps by which the access to the connection contacts can be closed in the securing status, wherein the short-circuit device can be interrupted by the insulating separation element in the securing status and the flaps and the separation element are mechanically coupled in such a way that the flaps are closed in the securing status and the short-circuit device is disconnected by the separation element, and the flaps are open in the release status and the short-circuit device shorts the connection contacts.

Such a flap mechanism has the advantage that safety device and current transformer are not formed in a number of parts, but the safety device is integrated in the current transformer.

Here, the open flaps furthermore may protrude advantageously from the current transformer, such that the status of the safety device is clearly visible, whereby the risk of a short-circuit device remaining accidentally in the shorted state is reduced.

The short-circuit device of the second embodiment advantageously has a sprung conductor as mechanically movable conductor, via which spring conductor the circuit between the connection contacts can be closed, wherein each of the connection contacts has a short-circuit contact or is electrically conductively connected to such a contact and the separation element can be slid between the sprung conductor and the short-circuit contacts in an insulating manner, such that the circuit between the connection contacts is interrupted.

The advantage of such an embodiment lies in the fact that the flap mechanism has a plurality of movable elements, one of which can be formed as a separation element, such that the same movement that opens or closes the flaps can close or open the short-circuit device via the separation element.

The movable elements of the flap mechanism, in particular separation element and flaps, are advantageously mechanically coupled by a hinge mechanism.

The movement that opens or closes the flaps thus can be deflected in various directions. This enables great degrees of freedom in terms of the embodiment for the position and the direction of movement of the separation element and also of the separation contact that can be disconnected thereby.

Here, a removal of the separation element causes a transition from the securing status into the release status. In principle however, it is also possible conversely to connect the flap mechanism to a closing contact, which for example is closed by a pressure element, as soon as the flaps release the access to the connection contacts.

Furthermore, the separation element is advantageously provided with lateral arms that are movably connected on either side to a flap, such that a distal removal of the separation element causes a lifting of the flaps.

Here the lateral arms provide the advantage that a tensile force acting on the separation element at a certain spot can be transmitted via the arms to the individual flaps. An influence of a tensile force on the separation element can thus cause a plurality of flaps or all flaps to open.

The current transformer advantageously is also formed such that a guide mechanism enables the flaps to slide thereon when raised from one side.

Such a guide mechanism offers the advantage that a reciprocating motion is converted into a rotary motion. Whereas a pure reciprocating motion would lead only to a lifting of the flaps, the guide mechanism causes a rotation of the flaps, whereby the housing opening is first exposed in a way that enables an insertion of a tool in order to release or fasten conductors from/to the connection contacts.

The current transformer is advantageously therefore also formed such that the housing openings via which the connection contacts can be reached have, at the edges thereof, at least partial guide rails or guide grooves, and the flaps on one side have a guide pin that lies in the guide rail or guide groove and is displaceable therein, such that the flaps slide in a manner guided via the guide mechanism when said flaps are raised from one side.

In a further advantageous embodiment of the invention the safety device can be formed as a displaceable contact cover.

Here, the safety device is formed as a contact cover that can be slid on or closed by displacement and that, closed in the securing status, blocks the access to a connection contact in the securing status.

Slid on in the release status, the contact cover further releases the access to the connection contact. Here, the short-circuit device, which has a sliding contact as mechanically movable conductor, is coupled to the contact cover in such a way that the short-circuit device can be opened or closed by displacement of the contact cover.

The advantage of this embodiment lies in the fact that this embodiment as current transformer with short-circuit device and safety device can also be embodied in one piece and additionally does not place high demands in terms of the overall height, since the overall height is the same in the securing status and in the release status or with closed and open short-circuit device.

The contact cover advantageously can be slid in the securing status into the housing of the current transformer for this purpose. Here, the displaceability of the contact cover entails not only the advantage of a low overall height, but also the advantage that the region above the housing opening remains freely accessible for a tool.

A contact cover of a connection contact advantageously can be slid on individually, wherein the connection contacts of the secondary coil can be shorted via each individual contact cover via a respective short-circuit device.

A very small design of safety device and short-circuit device is thus enabled, since the space into which a contact cover is slid for opening can be used alternately by different contact covers.

Since a respective short-circuit device is actuated by each contact cover, the secondary coil of the current transformer is then also shorted if just one of the contact covers is opened.

The contact cover and the sliding contact are advantageously rigidly interconnected or are formed as one element, such that a closure of the sliding contact causes the contact cover to be slid on.

This embodiment enables a very space-saving and mechanically robust arrangement, since a contact is opened and another is closed in accordance with the principle of a sliding change-over switch.

The sliding contact advantageously has detent lugs that cause and/or indicate a secure closure of the sliding contact and of the short-circuit device.

A noticeable latching of the detent lugs can additionally indicate that the contact cover has reached its target position. This is advantageously selected such that the sliding contact of the short-circuit device is securely closed.

In addition, the detent lugs hold the sliding contact reliably closed, such that the risk of the sliding element sliding apart from itself accidentally, possibly also only in part, with the possible result of destroying the current transformer can be prevented.

The invention will be explained in greater detail hereinafter with reference to the accompanying drawing on the basis of preferred embodiments.

In the drawing

Figure 1B:
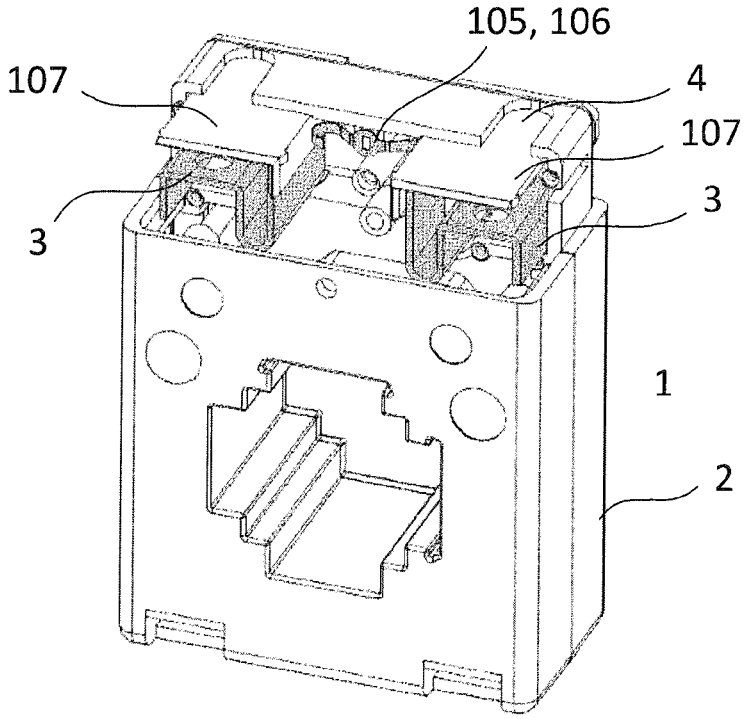
Figure 2A:
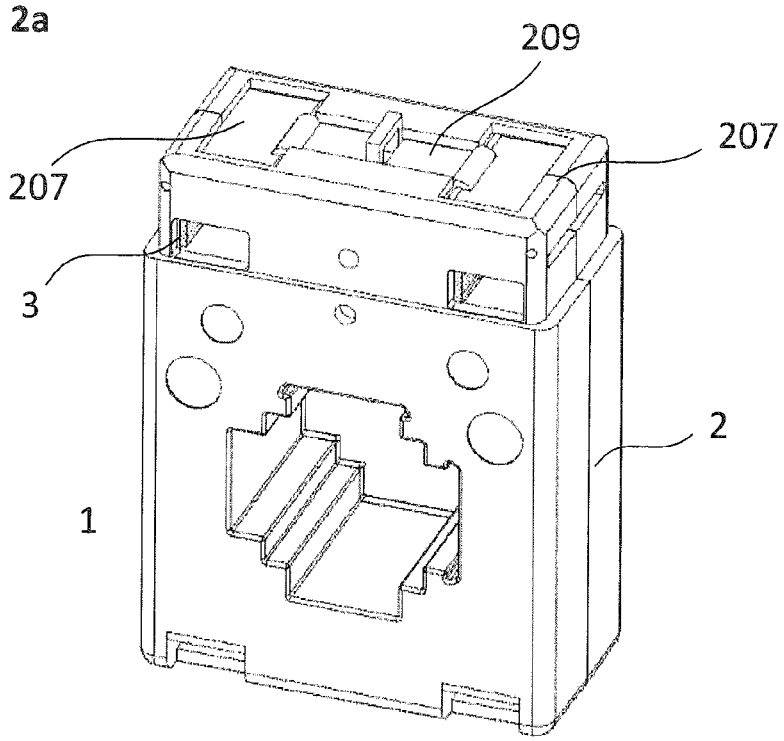
Figure 2B:
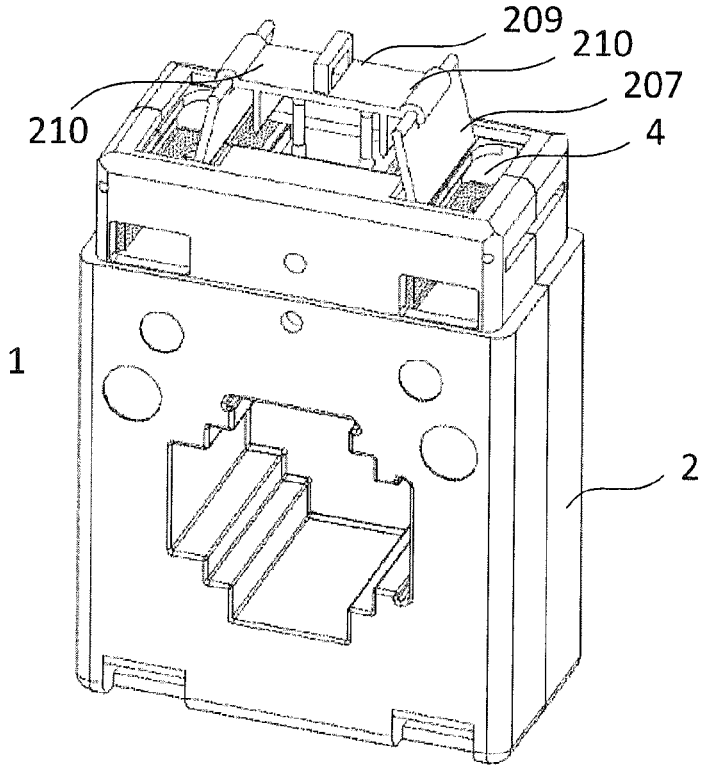
Figure 2C:
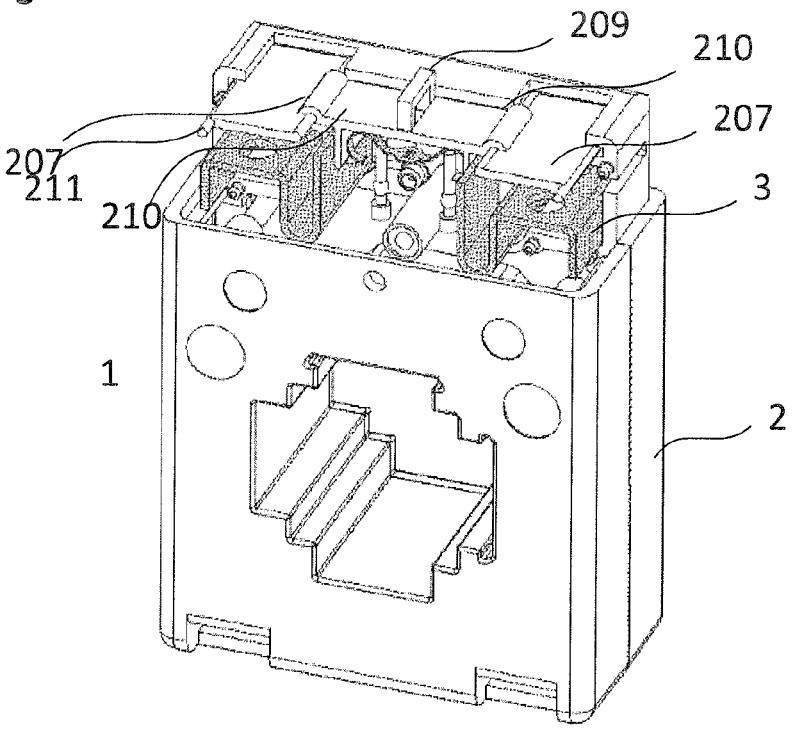
Figure 2D:
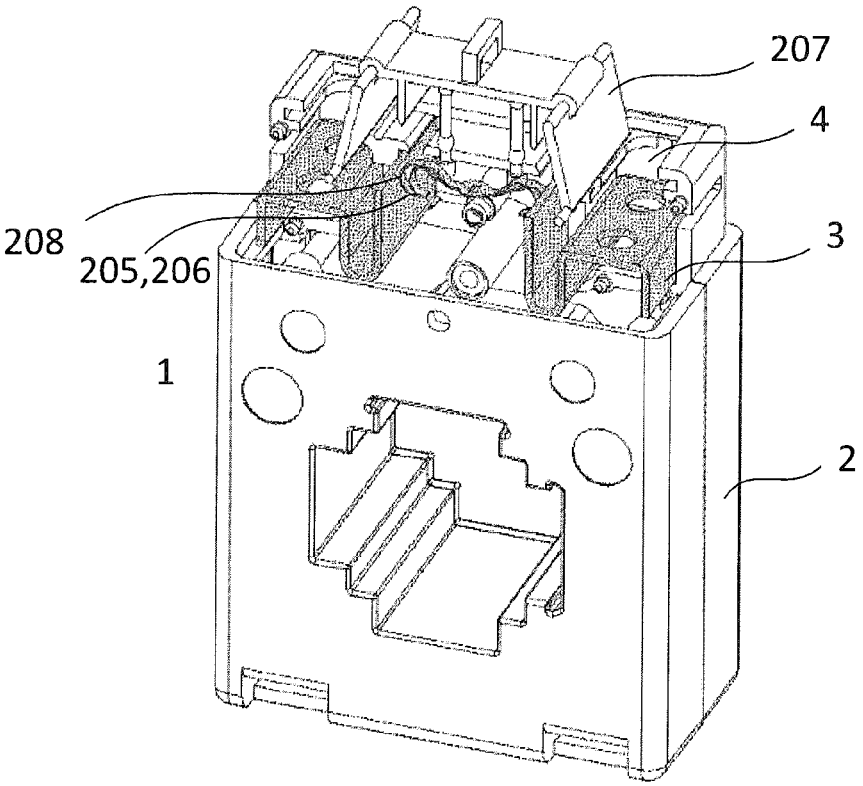
Figure 3A:
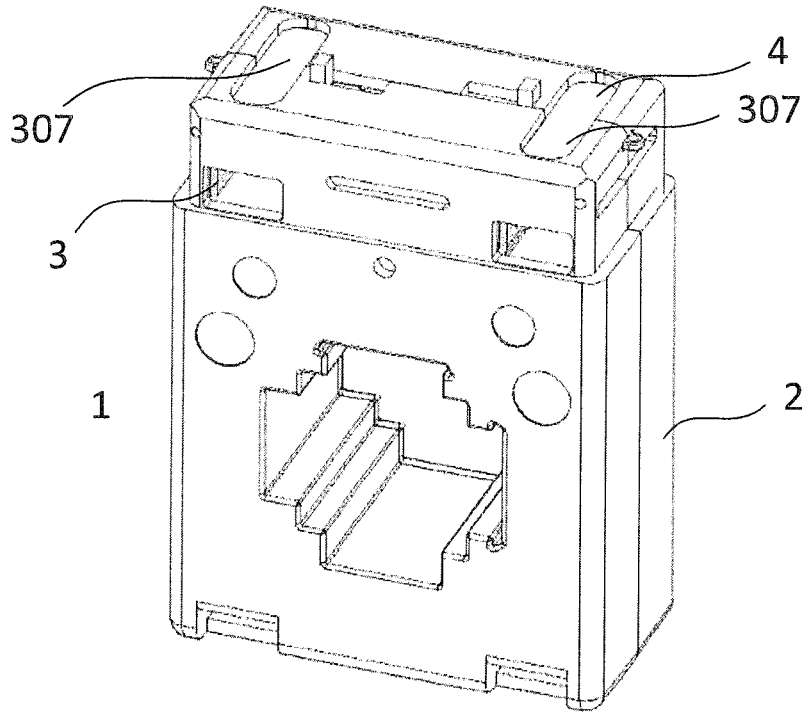
Figure 3B:
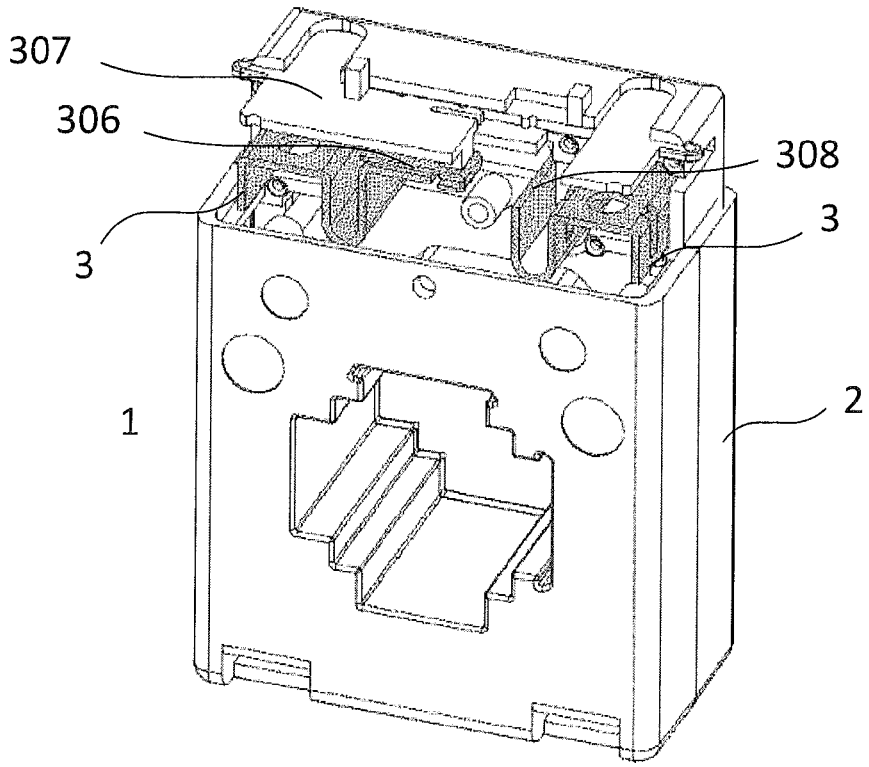
Figure 3C:
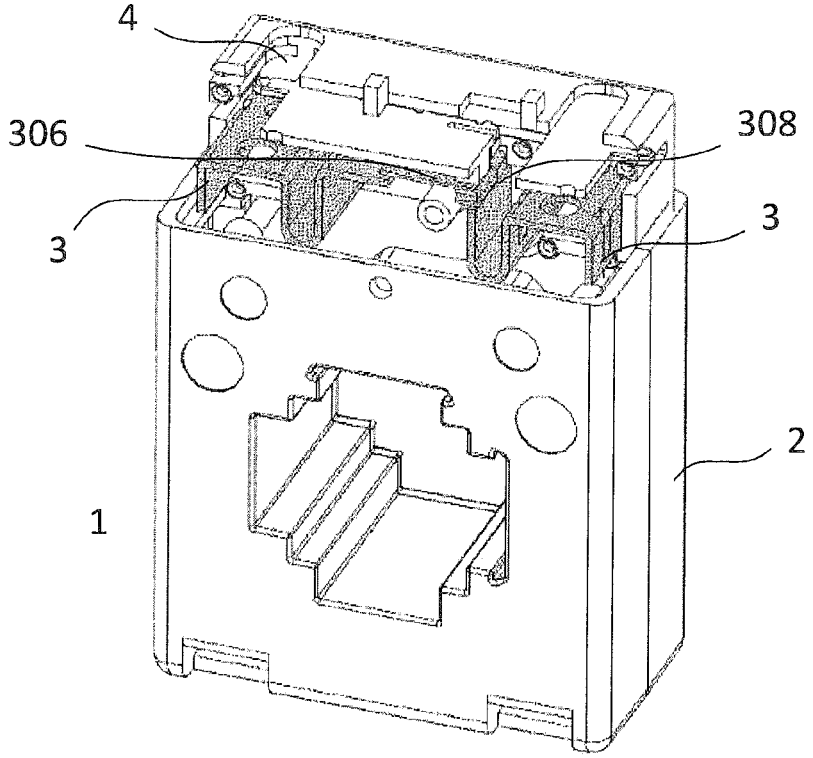
Figure 3D:
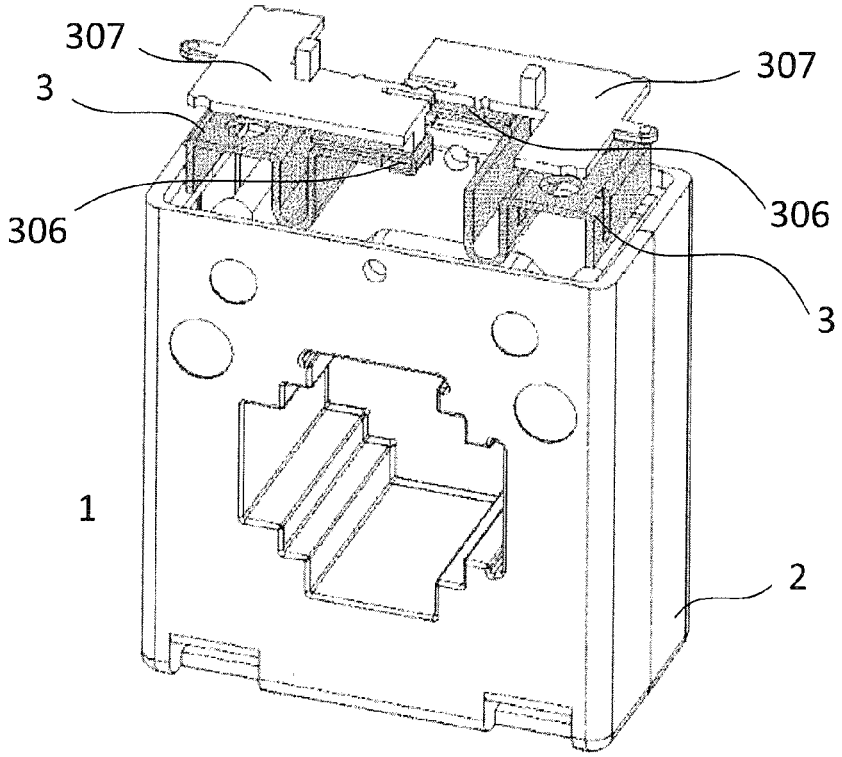
Figure 3E:
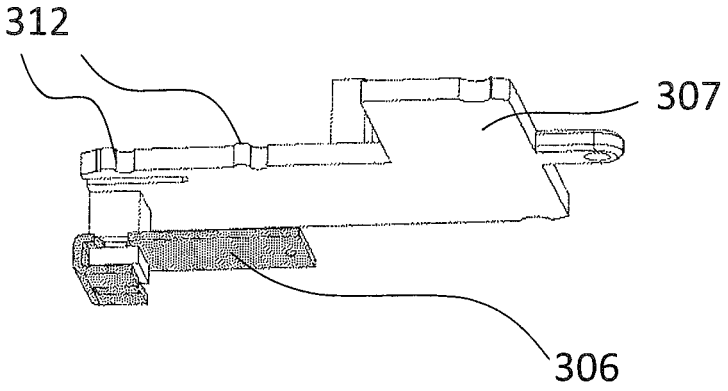

FIG. 1*a* shows a perspective illustration of a first embodiment of a current transformer according to the invention with shorted short-circuit device with partially open housing head, FIG. 1*b* shows a perspective illustration of a first embodiment of a current transformer according to the invention with open short-circuit device with partially open housing head, FIG. 2*a* shows a perspective illustration of a second embodiment of a current transformer according to the invention with open short-circuit device with complete housing, FIG. 2*b* shows a second embodiment of a current transformer according to the invention with shorted short-circuit device (perspective illustration with complete housing), FIG. 2*c* shows a perspective illustration of a second embodiment of a current transformer according to the invention with open short-circuit device with partially open housing head, FIG. 2*d* shows a perspective illustration of a second embodiment of a current transformer according to the invention with shorted short-circuit device with partially open housing head, FIG. 3*a* shows a perspective illustration of a third embodiment of a current transformer according to the invention with open short-circuit device with complete housing, FIG. 3*b* shows a perspective illustration of a third embodiment of a current transformer according to the invention with open short-circuit device with partially open housing head, FIG. 3*c* shows a perspective illustration of a third embodiment of a current transformer according to the invention with closed short-circuit device with contact cover open on the left side with partially open housing head, FIG. 3*d* shows a perspective illustration of a third embodiment of a current transformer according to the invention with open short-circuit device with open housing head, and FIG. 3*e* shows a perspective illustration of a safety device of a third embodiment of a current transformer according to the invention.

All views are illustrated hereinafter without screws.

FIG. 1*a* shows a first embodiment of a current transformer 1 according to the invention. The illustration is perspective, the short-circuit device 105 with a short-circuit contact 108 is located in a shorted position, and half of the housing head is removed to provide an improved view.

The lower part of the housing 2, which is square in projection, comprises a secondary winding with a ferromagnetic core. The central opening of the housing 2 is used to pass through a primary conductor, wherein the profile of the opening is suitable for accommodating bus bars in conventional, standardised formats with an accurate fit.

The upper part of the housing 2 contains the connection contacts 3 of the current transformer 1 as housing head, the ends of the secondary winding (not shown here) being electrically connected to said connection contacts.

In the region of the connection contacts 3, the housing head has lateral and also end-face openings, wherein the lateral openings are used to supply connection conductors and the end-face housing openings 4 are used for manipulation of the connection contacts 3.

The short-circuit device 105 of the embodiment of the invention shown in FIG. 1 is closed, the resilient conductor 106 contacts the connection contacts 3 on either side at the short-circuit contact 108 and thus closes the circuit between the connection contacts 3.

FIG. 1*a* further shows two safety devices 107 in the form of cover sleeves 107. These are flat and are formed as an angle in profile, such that they can cover the connection contacts 3 from two sides. To this end, they can be introduced laterally into the housing 1, wherein the housing 1 provides corresponding slots (not visible here) for this purpose.

FIG. 1*b* shows the same embodiment of a current transformer 1 according to the invention with open short-circuit device 105. The cover sleeves 107 are introduced into the housing 2 on either side. Due to the angle profile thereof, the cover sleeves 107 are suitable both for covering the connection contacts 3 from above and for separating said connection contacts laterally from the sprung conductor 106.

The cover sleeves 107 close the housing opening 4 and therefore the access to the connection contacts 3. Further, they are slid in so as to insulate between the connection contacts 3 and the sprung conductor 106.

FIG. 2*a* shows a second embodiment of the invention. This is a perspective illustration, wherein the housing 2 is illustrated completely closed.

The coil former with the secondary coil hidden by the housing 2 corresponds to that of the first embodiment of the invention.

The embodiment of the connection contacts 3 also corresponds to that of the first embodiment, wherein part of the connection contacts 3 is visible at the lateral openings for the supply of the connection conductors.

On the end face the current transformer 1 has two flaps 207, by which the connection contacts 3 arranged beneath are hidden. The flaps 207 are mechanically connected to a separation element 209. The separation element 209 has an eyelet for manipulation. At the same time, the eyelet is suitable for the fastening of a wire seal (not shown here).

The separation element 209 can be secured against unauthorised actuation in conjunction with a second eyelet, the eyelet attached to the housing 2 or a suitable housing opening.

FIG. 2*b* shows the same embodiment of a current transformer 1 according to the invention, wherein the separation element 209 has been moved away from the current transformer 1 (upwardly in the illustration). The flaps 207 release the housing openings 4 arranged beneath, such that the connection contacts 3 are accessible.

Here, the flaps 207 are fastened rotatably to the arms 210 of the separation element 209, such that the flaps 207 are not raised vertically, but fold away downwards in the illustration and thus release the housing opening 4.

FIG. 2*c* shows the same embodiment of the current transformer 1, wherein half of the housing head has been removed to provide an improved view.

The flaps 207 closed in FIG. 2*c* have, at the outer corners thereof, a guide pin 211 that is displaceable in a guide groove below the housing opening 4, such that the flap 207 swings open when pulled vertically, irrespective of an orientation of installation (also laterally or upside down).

FIG. 2*c* also shows the interruption of the contacts between the connection contacts 3 and the sprung conductor 206 by the separation element 209.

FIG. 2*d* shows the same illustration with open flaps 207 and closed short-circuit device 205. The flaps 207 are swung open in a manner guided in the groove and release the access to the connection contacts 3. The separation element 209 has been removed between the connection contact 3 and the sprung conductor 206 such that the sprung conductor 206 contacts the connection contact 3 at the short-circuit contact 208 thereof and thus closes the short-circuit device 205.

FIG. 3*a* shows a third embodiment of the invention. This is a perspective illustration, wherein the housing 2 is illustrated completely closed.

The coil former with the secondary coil hidden by the housing 2 corresponds to that of the first embodiment of the invention.

The embodiment of the connection contacts 3 also corresponds to that of the first embodiment, wherein part of the connection contacts 3 is visible at the lateral openings for the supply of the connection conductors.

At the end face, the current transformer 1 has housing openings 4, which provide access to the actuation elements of the connection contacts 3, but are closed in FIG. 3*a* by the safety device 307.

An embodiment of the safety device 307 as a displaceable contact cover 307 is visible from FIG. 3*b*. This has a sliding arm, which can be actuated externally through a corresponding opening of the housing 2. Further, the contact cover 307 is connected to the movable conductor 306. The movable conductor 306 is formed as a sliding contact 306 and can be conductively connected to the connection contacts 3 at the short-circuit contact 308. Here, said sliding contact is also in contact with the connection contact 3 of the other connection contact 3 of the secondary coil, such that the circuit between the connection contacts 3 of the secondary coil can be closed via the sliding contact 306.

FIG. 3*c* shows the same embodiment of the current transformer with half the housing head removed. A contact cover 307 is displaced parallel to the surface of the housing 2 in the direction of the longitudinal axis of the current transformer, such that the access to the corresponding connection contacts 3 via the housing opening 4 is accessible. At the same time, the sliding contact 306 connected to the contact cover 307 contacts the other connection contact 3 at the short-circuit contact 308, such that the circuit between the connection contacts 3 of the secondary terminals is closed.

In the meantime, the second contact cover 307 is closed. Depending on the available space between the connection terminals 3, an embodiment such that the second contact cover 307 is to be open simultaneously is also possible. If the contact covers 307 lie in a plane, this is thus possible when the available space between the accesses to the connection contacts 3 corresponds in terms of width at least to the joint width of the two contact covers 307.

FIG. 3*d* shows the same embodiment of the current transformer 1 with open housing head and closed contact covers 307. Here, it can be seen that the contact covers 307 and the sliding contacts 306 connected thereto are formed symmetrically to one another and each contact cover 307 can close a short-circuit device 305 by means of a sliding contact 306. It can also be seen that both contact covers lie in a plane.

This property is advantageous in order to be able to latch the two contact covers 307 to one another in a simple manner via detent lugs 312.

FIG. 3*e* shows a corresponding embodiment of the contact cover 307. Here, the contact cover has laterally arranged detent lugs 312, which are suitable for latching two symmetrical contact covers 307 in different positions along the axis of displacement. The illustration shows two detent lugs that are suitable for latching the contact covers 307 in two positions. In the illustrated embodiment these positions on the one hand are the position in which only one of the contact covers 307 is open and on the other hand the position in which both contact covers 307 are closed. In principle the contact cover 307 (not shown here) can have a third detent lug for latching in a third position in which both contact covers 307 are open.

FIG. 3*e* also shows that the safety device 307 in the form of the contact cover 307 is rigidly connected to the sliding contact 306 in this embodiment.

LIST OF REFERENCE SIGNS current transformer 1
housing 2
connection contact 3
housing opening 4
short-circuit device 105, 205, 305
movable conductor 106, 206, 306
sprung conductor 106, 206
sliding contact 306
safety device 107, 207, 307
cover sleeve 107
flap 207
contact cover 307
short-circuit device 108, 208, 308
separation element 209
arm 210
guide pin 211
detent lug 312

The invention claimed is:

1. A current transformer, comprising connection contacts for contacting a secondary winding of the current transformer, which connection contacts can be reached through a housing opening of the housing surrounding the current transformer, wherein the current transformer has a short-circuit device for shorting the connection contacts and the short-circuit device has a mechanically movable conductor that can be brought into a circuit between the connection contacts of the secondary winding, the current transformer having a safety device for blocking the access to the connection contacts lying inside the housing, which safety device can be in a securing status or release status, wherein the access to the connection contacts is blocked by the safety device in the securing status, such that the connection of a conductor to a connection contact or the disconnection of a conductor from a connection contact is not possible and the access to the connection contacts is released by the safety device in the release status and the short-circuit device shorts the connection contacts in the release status, such that the connection of a conductor to a connection contact or a disconnection of a conductor from a connection contact is possible.

2. The current transformer according to claim 1, characterised in that the safety device is formed as a cover sleeve which can be inserted into the housing in such a way that it blocks the access to the connection contacts and at the same time opens the short-circuit device.

3. The current transformer according to claim 1, characterised in that the safety device is formed as a flap mechanism that has an insulating separation element and flaps by which the access to the connection contacts can be closed in the securing status, wherein the short-circuit device can be interrupted by the insulating separation element in the securing status and the flaps and the separation element are mechanically coupled in such a way that the flaps are closed in the securing status and the short-circuit device is disconnected by the separation element and the flaps are open in the release status and the short-circuit device shorts the connection contacts.

4. The current transformer according to claim 3, characterised in that the separation element is provided with lateral arms that are movably connected on either side to a flap, such that a distal removal of the separation element causes a lifting of the flaps.

5. The current transformer according to claim 3, characterised in that a guide mechanism enables the flaps to slide thereon when raised from one side.

6. The current transformer according to claim 1, characterised in that the short-circuit device is formed as a disconnecting switch, via which the circuit between the connection contacts can be disconnected by an element of the safety device in the form of a cover sleeve or a separation element in the securing status.

7. The current transformer according to claim 1, characterised in that the short-circuit device has a sprung conductor as mechanically movable conductor via which the circuit between the connection contacts can be closed, each of the connection contacts has a short-circuit contact or is electrically conductively connected to such a contact, an element of the safety device is formed as a cover sleeve or as a separation element formed of insulating material, and the cover sleeve or the separation element can be inserted between the sprung conductor and the short-circuit contacts in an insulating manner, such that the circuit between the connection contacts is interrupted.

8. The current transformer according to claim 1, characterised in that the safety device is formed as a contact cover that can be slid on or closed by displacement and that, closed in the securing status, blocks the access to a connection contact in the securing status and that, slid on in the release status, releases the access to the connection contact, and wherein the short-circuit device, which has a sliding contact as mechanically movable conductor, is coupled to the contact cover in such a way that the short-circuit device can be opened or closed by displacement of the contact cover.

9. The current transformer according to claim 8, characterised in that a contact cover of a connection contact can be slid on individually and the connection contacts of the secondary coil can be shorted via each individual contact cover via a respective short-circuit device.

10. The current transformer according to claim 8, characterised in that the contact cover and the sliding contact are rigidly interconnected or are formed as one element, such that a closure of the sliding contact causes the contact cover to be slid on.

11. The current transformer according to claim 8, characterised in that the sliding contact has detent lugs that cause and/or indicate a secure closure of the sliding contact and of the short-circuit device.

12. The current transformer according to claim 4, characterised in that a guide mechanism enables the flaps to slide thereon when raised from one side.

13. The current transformer according to claim 2, characterised in that the short-circuit device is formed as a disconnecting switch, via which the circuit between the connection contacts can be disconnected by an element of the safety device in the form of a cover sleeve or a separation element in the securing status.

14. The current transformer according to claim 3, characterised in that the short-circuit device is formed as a disconnecting switch, via which the circuit between the connection contacts can be disconnected by an element of the safety device in the form of a cover sleeve or a separation element in the securing status.

15. The current transformer according to claim 4, characterised in that the short-circuit device is formed as a disconnecting switch, via which the circuit between the connection contacts can be disconnected by an element of the safety device in the form of a cover sleeve or a separation element in the securing status.

16. The current transformer according to claim 2, characterised in that the short-circuit device has a sprung conductor as mechanically movable conductor via which the circuit between the connection contacts can be closed, each of the connection contacts has a short-circuit contact or is electrically conductively connected to such a contact, an element of the safety device is formed as a cover sleeve or as a separation element formed of insulating material, and the cover sleeve or the separation element can be inserted between the sprung conductor and the short-circuit contacts in an insulating manner, such that the circuit between the connection contacts is interrupted.

17. The current transformer according to claim 3, characterised in that the short-circuit device has a sprung conductor as mechanically movable conductor via which the circuit between the connection contacts can be closed, each of the connection contacts has a short-circuit contact or is electrically conductively connected to such a contact, an element of the safety device is formed as a cover sleeve or as a separation element formed of insulating material, and the cover sleeve or the separation element can be inserted between the sprung conductor and the short-circuit contacts in an insulating manner, such that the circuit between the connection contacts is interrupted.

18. The current transformer according to claim 9, characterised in that the contact cover and the sliding contact are rigidly interconnected or are formed as one element, such that a closure of the sliding contact causes the contact cover to be slid on.

19. The current transformer according to claim 9, characterised in that the sliding contact has detent lugs that cause and/or indicate a secure closure of the sliding contact and of the short-circuit device.

20. The current transformer according to claim 10, characterised in that the sliding contact has detent lugs that cause and/or indicate a secure closure of the sliding contact and of the short-circuit device.

* * * * *